US008727027B2

(12) United States Patent
Schilte et al.

(10) Patent No.: US 8,727,027 B2
(45) Date of Patent: May 20, 2014

(54) DOWNHOLE SEAL

(75) Inventors: Paul Schilte, Rijswijk (NL); John Dewar, Edinburgh (GB); Arie Vliegenthart, Maassluis (NL)

(73) Assignee: Swellfix B.V., Rijswijk (NL)

( * ) Notice: Subject to any disclaimer, the term of this patent is extended or adjusted under 35 U.S.C. 154(b) by 891 days.

(21) Appl. No.: 12/865,981

(22) PCT Filed: Feb. 5, 2009

(86) PCT No.: PCT/GB2009/000327

§ 371 (c)(1),
(2), (4) Date: Apr. 28, 2011

(87) PCT Pub. No.: WO2009/098465

PCT Pub. Date: Aug. 13, 2009

(65) Prior Publication Data

US 2011/0193291 A1 Aug. 11, 2011

(30) Foreign Application Priority Data

Feb. 7, 2008 (GB) ..... 0802237.8

(51) Int. Cl.
*E21B 33/128* (2006.01)

(52) U.S. Cl.
USPC ..... 166/387; 166/180; 166/196

(58) Field of Classification Search
USPC ..... 166/387, 179, 180, 196
See application file for complete search history.

(56) References Cited

U.S. PATENT DOCUMENTS

| | | | | |
|---|---|---|---|---|
| 7,387,168 | B2 * | 6/2008 | Ellington et al. | 166/380 |
| 7,543,639 | B2 | 6/2009 | Emerson | |
| 2003/0079887 | A1 | 5/2003 | Lloyd et al. | |
| 2004/0112609 | A1 | 6/2004 | Whanger et al. | |
| 2005/0110217 | A1 | 5/2005 | Wood et al. | |
| 2007/0114018 | A1 * | 5/2007 | Brezinski et al. | 166/207 |
| 2007/0163777 | A1 | 7/2007 | Murray et al. | |
| 2012/0227957 | A1 * | 9/2012 | Xu et al. | 166/118 |

OTHER PUBLICATIONS

International Search Report for PCT/GB2009/000327 issued Jun. 8, 2009.
Written Opinion for PCT/GB2009/000327 issued Jun. 8, 2009.
International Preliminary Report on Patentability for PCT/GB2009/000327 issued Aug. 10, 2010.

* cited by examiner

*Primary Examiner* — William P Neuder
(74) *Attorney, Agent, or Firm* — Meyertons, Hood, Kivlin, Kowert & Goetzel, P.C.; Eric B. Meyertons

(57) ABSTRACT

An expandable downhole seal includes a sealing portion and a deflecting portion adapted to move axially relative to each other to effect radial displacement of the sealing portion, wherein at least one of the sealing portion and the deflecting portion includes a swelling material. In use, radial expansion of the downhole seal may be achieved by the radial displacement of the sealing portion in combination with swelling of the swellable material. A support member is provided to support the sealing portion and deflecting portion.

26 Claims, 5 Drawing Sheets

DOWNHOLE SEAL

BACKGROUND OF THE INVENTION

1. Field of the Invention

The present invention relates to a downhole seal, and in particular to a downhole seal which incorporates a swelling material.

2. Description of the Relevant Art

It is often necessary to establish seals in downhole locations, such as in hydrocarbon exploration and production wellbores. In many cases seals must be established in annular areas, such as between a tubing string and a wall of the wellbore, for example an open bore wall or a cased or lined bore wall. Annular seals of the type described are conventionally identified as packers.

Many forms of downhole seals or packers are currently utilized which are arranged or mounted on the outer surface of a tubing string, such as a production tubing string or the like. Typically, the seals or packers are radially expandable such that they may be run into the wellbore while describing a reduced diameter, and then radially expanded to establish a seal at the required downhole location. Various arrangements exist for providing the required radial expansion. For example, seals may incorporate inflatable bladders which may be filled with a pressurized fluid. However, where high expansion ratios are required these inflatable bladders may become unstable, especially when exposed to large pressure differentials. Additionally, should the integrity of the bladder become compromised it may be difficult to maintain any form of seal.

Mechanical expansion arrangements exist which involve the axial compression of an elastic or otherwise deformable material to cause the material to extend radially. Such mechanically expandable seals, however, have limited capabilities when large expansion ratios are required. Additionally, actuation of such mechanical arrangements may involve complicated assemblies to ensure sufficient operation, and to ensure that axial actuation forces are efficiently and accurately converted to the required radial forces to establish the required seal.

US 2003/0079887 discloses a mechanical expansion arrangement in which top and bottom sealing rings are disposed on either side of a double-ramped cylinder. An end of each sealing ring includes a metallic structure and an elastomeric material, wherein the ends are arranged to be outwardly deflected by the double ramped cylinder into contact with an outer tubular to establish a seal. This known arrangement provides a combined elastomeric and metal-to-metal seal against the outer tubular.

Expandable seals which incorporate swelling materials are also known. Such seals normally comprise a band of swellable material, such as a swelling elastomer, mounted on the outer surface of a tubular body. When the swellable material is exposed to a particular activator, such as water, oil or the like, the material will radially expand. While such swelling materials can readily achieve large expansion ratios, it is understood in the art that the mechanical properties of conventional swelling materials diminish with increasing expansion or swelling. Thus, highly swollen materials are often considered unsuitable for downhole use.

As described above, many arrangements of expandable seals are known, although it is recognized that effective seals are very difficult to achieve where a high expansion ratio is required. This is a significant problem in the art as the architecture of a typical downhole environment normally requires a seal to be established in a large diameter bore, such as an overgauge or underreamed section, with access only provided through sections of a wellbore with relatively small internal diameters and restrictions. As such, seals which can accommodate such conventional downhole architecture and provide large expansion ratios are desired.

SUMMARY OF THE INVENTION

According to an embodiment there is provided an expandable downhole seal including:

- a sealing portion and a deflecting portion adapted to move axially relative to each other to effect radial displacement of the sealing portion, wherein at least one of the sealing portion and the deflecting portion includes a swelling material; and
- a support member adapted to support the sealing portion and deflecting portion.

In use, radial expansion of the downhole seal may be achieved by the radial displacement of the sealing portion in combination with swelling of the swellable material. As such, the downhole seal may advantageously be employed in environments where a large expansion ratio is required, such as in situations where the intended location of the seal can only be accessed via passageways or conduits of restricted or reduced internal dimensions and profiles.

The entire sealing portion may be radially displaced. Alternatively, at least part of the sealing portion may be radially displaced.

The sealing portion may be adapted to engage an inner surface of a bore, such as the inner surface of a open bore hole, a casing tubular, liner tubular or the like. In this manner the downhole seal may be adapted to establish a seal in an annulus or other suitably shaped region defined between a bore wall and the support member. The downhole seal may therefore be utilised as a packer.

The downhole seal may be adapted to provide a downhole anchor, such as a tubing hanger or the like.

The sealing portion may be adapted to directly engage the inner surface of a bore. Alternatively, the sealing portion may be adapted to indirectly engage the inner surface of a bore, for example via a further sealing portion, resilient material, deformable material, sealing material, or the like, or any suitable combination thereof.

It should be understood that relative axial movement of the sealing and deflecting portions and subsequent radial displacement of the sealing portion may be achieved with reference to the support member. The support member may be solid, hollow or the like. In one embodiment the support member may include a tubular member, such as a production tubular, casing tubular, liner tubular, coiled tubing or the like. The support member may be unitary. Alternatively, the support member may include a plurality of sections, which sections may be coupled together. For example, the support member may include a plurality of tubular bodies coupled together in end-to-end relation to define a tubing string. The sealing and deflecting portions may be provided on a single section, or on different sections of the support member. At least one of the sealing and deflecting portions may function as a connector to permit different sections of the support member to be connected together.

One of the sealing and deflecting portions may be fixed relative to the support member and the other of the sealing and deflecting portions may be axially moveable relative to the support member. Alternatively, both the sealing and deflecting portions may be axially moveable. Accordingly, relative axial movement of the sealing and deflecting portions may be achieved by displacement of one or both of said portions.

Relative axial movement of the sealing and deflecting portions may be achieved hydraulically, pneumatically, mechanically or the like. For example, relative axial movement may be achieved by a piston arrangement, motor drive or the like. It should be understood, however, that any suitable arrangement for achieving relative axial movement of the sealing and deflecting portions may be utilised, as would be readily selected by a person of skill in the art.

The sealing and deflecting portions may be adapted to interengage, either directly or indirectly, upon relative axial movement thereof, wherein said interengagement effects radial displacement of the sealing portion. Interengagement of the sealing and deflecting portions may be achieved by overlapping of said portions in an axial direction. In one embodiment, one of the sealing and deflecting portions may axially overlap an outer surface of the other of the sealing and deflecting portions. Alternatively, or additionally, one of the sealing and deflecting portions may be received within the other portion. For example, one of the sealing and deflecting portions may define a pocket, recess, cavity, slot or the like adapted to receive the other portion therein.

One or both of the sealing and deflecting portions may include a cam surface adapted to effect radial displacement of the sealing portion upon relative axial movement of the sealing and deflecting portions. The cam surface may include a linear cam surface. Alternatively, or additionally, the cam surface may include a rotational cam surface. The cam surface may include a wedge profile, ramp profile, arcuate profile, conical surface or the like.

In one embodiment the deflecting portion may include a cam surface adapted to radially deflect or displace the sealing portion. In this arrangement the deflecting portion may define a mandrel, cone or the like.

The sealing portion may include a unitary component. For example, the sealing portion may include a sleeve adapted to engage the deflecting portion. Alternatively, the sealing portion may include a plurality of components which collectively define the sealing portion. For example, the sealing portion may include a plurality of webs, plates, fingers, collets, pads, slips, wedges or the like. The individual components forming the sealing portion may or may not be connected together.

The sealing portion may define a first sealing portion and the expandable downhole seal may further include a second seal portion, wherein relative axial movement of the first and second sealing portions and the deflecting portion effects radial displacement of the first sealing portion and optionally radial displacement of the second sealing portion. The second sealing portion may be similar in some or all respects to the first sealing portion and as such for brevity it should be assumed that preferred and optional features of the sealing portion identified herein may apply to the second sealing portion.

At least one of the first and second sealing portions and the deflecting portion may be fixed relative to the support member, wherein movement of the remaining portions may produce the required relative axial movement. In embodiments movement of each of the first and second sealing portions and the deflecting portion may effect the required relative axial movement.

The first and second sealing portions may be located on axially opposed sides of the deflecting portion. That is, in certain configurations of the downhole seal the deflecting portion may be interposed between the first and second sealing portions. In this arrangement movement of the deflecting portion and one of the first and second sealing portions may cause radial displacement of at least the first sealing portion. Alternatively, the first and second sealing portions may both be movable, preferably towards each other and relative to the deflecting portion to effect radial displacement of at least the first sealing portion.

In embodiments where first and second sealing portions are located on axially opposite sides of the deflecting portion, the deflecting portion may include a single cam surface adapted to interengage, either directly or indirectly, with each of the first and second sealing portions. Alternatively, the deflecting member may include a plurality of cam surfaces adapted to interengage with a respective sealing portion. In one embodiment the deflecting portion may include a double cone structure.

In an alternative arrangement the first and second sealing portions may be located on the same axial side of the deflecting member. Movement of one or more of the portions may produce the required relative axial movement and thus radial displacement of at least the first sealing member.

In embodiments including first and second sealing portions, said portions may be adapted to interengage, either directly or indirectly. For example, the first and second sealing portions may be adapted to overlap each other in an axial direction. The first and second sealing portions may be adapted to interleave each other. The first and second sealing portions may include complementary interleaving features. For example, the first and second sealing portions may include respective axially extending features adapted to interleave with each other. In one embodiment each sealing portion includes a plurality of circumferentially arranged axially extending members defining circumferential gaps therebetween, wherein the axially extending members of the opposing sealing portions are received in corresponding circumferential gaps.

The first and second sealing portions may be adapted to collectively define a single sealing unit.

The downhole seal may include further sealing portions. In embodiments the sealing portions may each be adapted to interengage with the deflecting portion to be radially displaced. The sealing portions may be adapted to be radially stacked to provide expansion of the seal.

The seal portion may include the swelling material. Alternatively, or additionally, the deflecting portion may include the swelling material. The swelling material may be adapted to swell when exposed to water, oil, heat, pressure, or the like.

In embodiments where the sealing portion includes a swelling material, the entire sealing portion may be formed of a swelling material or combination of swelling materials. Alternatively, the sealing portion may include a seal support upon which the selling material is mounted. The seal support may include a rigid component, resilient component, deformable component or the like, or any suitable combination thereof.

The deflecting portion may include a unitary component, or alternatively may be defined by multiple components, which may or may not be interconnected.

The downhole seal may be adapted to be retrievable. For example, relative axial movement of the sealing and deflecting portions in a reverse direction may effect radial displacement of the sealing portion in a direction to release or relax the seal, thus permitting the support member to be withdrawn or moved to an alternative location.

According to an embodiment there is provided a method of establishing a seal within a wellbore, said method including:

providing an expandable downhole seal according to the first aspect;

running said downhole seal into a well bore when in a first, unexpanded configuration;

reconfiguring the downhole seal into a second, expanded configuration by effecting relative axial movement of the sealing portion and the deflecting portion; and permitting the swelling material to swell.

Accordingly, in use, a seal may be established downhole by virtue of the relative axial movement of the sealing and deflecting portions in combination with swelling of the swellable material.

The swelling material may be permitted to swell by exposure to a suitable activator, such as water, hydrocarbons or the like. The method may include the step of running the downhole seal into a well bore filled with a material which does not initiate swelling of the swelling material. Accordingly, the swelling material may be maintained in an unexpanded state while being run into the wellbore thus preventing the possibility a seal being established prematurely. The method may include the further step of displacing wellbore fluid with a suitable activator once the downhole seal has reached or is approaching the desired location within the wellbore.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
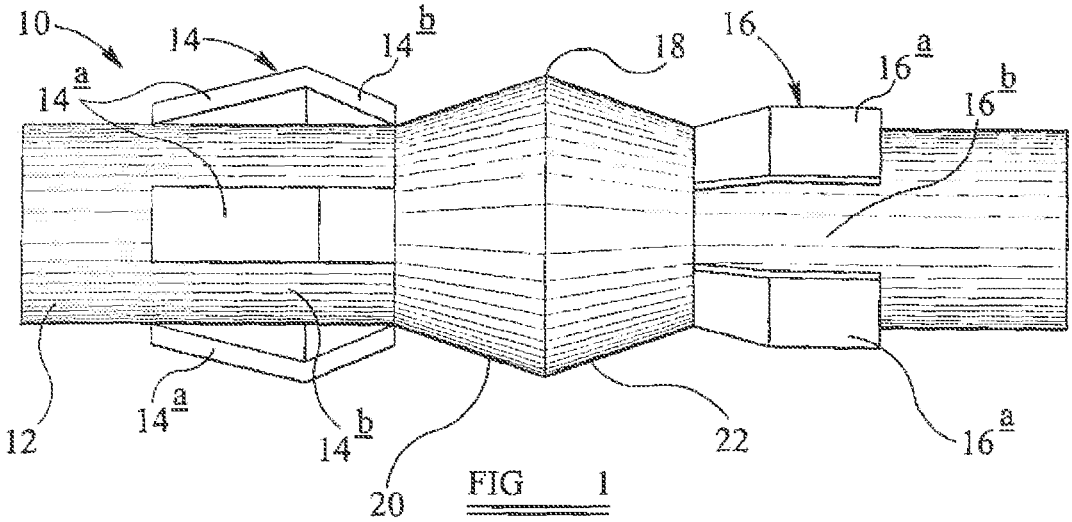
FIG. 1 is a diagrammatic representation of a downhole expandable seal in accordance with one embodiment.
Figure 2:
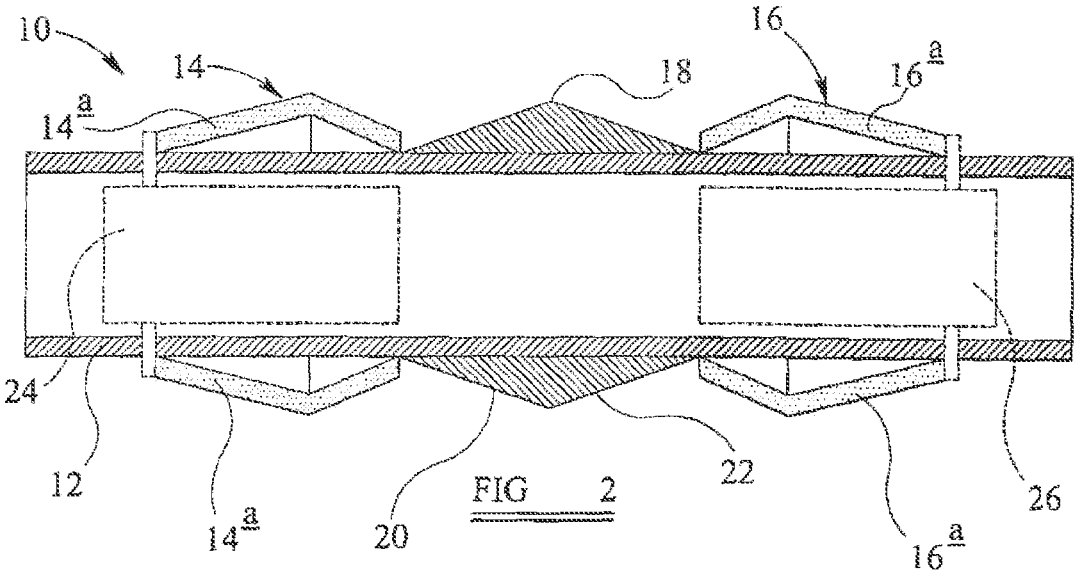
FIGS. 2, 3 and 4 are longitudinal cross-sectional views of the downhole seal of FIG. 1, shown in various stages of being reconfigured from an unexpanded to an expanded configuration.

Reference is first made to FIGS. 1 and 2 of the drawings in which there is shown diagrammatic plan and longitudinal cross-sectional views, respectively, of a downhole expandable seal, generally identified by reference numeral 10, in accordance with an embodiment. The seal 10, which is shown in FIGS. 1 and 2 in an unexpanded configuration, includes a support member in the form of a tubular body 12. The tubular body 12 may be adapted to form part of a tubing string, such as a production tubing string. As will be described in further detail below, the downhole seal 10 may be utilised as a packer to establish a seal in an annulus formed between the tubular body 12 and a wall of a wellbore.

The seal 10 further includes a deflecting portion 18 and first and second sealing portions 14, 16 arranged on the tubular body 12, wherein the sealing portions 14, 16 are located on axially opposed sides of the deflecting portion 18. In the embodiment shown the first and second sealing portions 14, 16 are axially slidably mounted relative to the tubular body 12, and the deflecting portion 18 is axially fixed relative to the tubular body 12.

Figure 3:
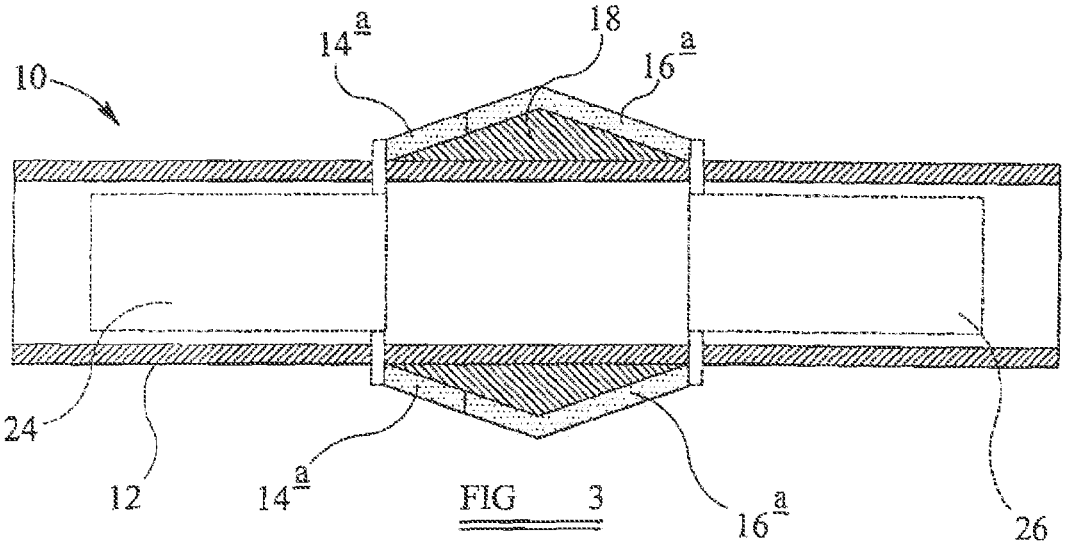

The deflecting portion 18 defines a double-ended conical shaped mandrel and includes first and second cam surfaces 20, 22 adapted to be engaged by the first and second sealing portions 14, 16, respectively. In use, axial movement of the first and second sealing portions 14, 16 in a direction to axially overlap the deflecting portion 18 effects outward radial displacement of said sealing portions 14, 16 by engagement with the respective cam surfaces 20, 22, as shown in FIG. 3 in which the seal 10 is shown in a partially expanded configuration. Respective piston drive assemblies 24, 26, diagrammatically represented in phantom outline in FIGS. 2 and 3, are provided for use in axially translating each sealing portion 14, 16.

Each sealing assembly 14, 16 includes a plurality of circumferentially arranged axially extending members 14*a*, 16*a* which define respective gaps 14*b*, 16*b* therebetween, as shown in FIG. 1. In use, the axially extending members 14*a*, 16*a* of each sealing portion 14, 16 are adapted to interleave each other such that axially extending members 14*a* are received within gaps 16*b*, and similarly axially extending members 16*a* are received within gaps 14*b*. In this way, the first and second sealing portions 14, 16 may be configured to collectively define a single sealing unit, as shown in FIG. 3.

Figure 4:
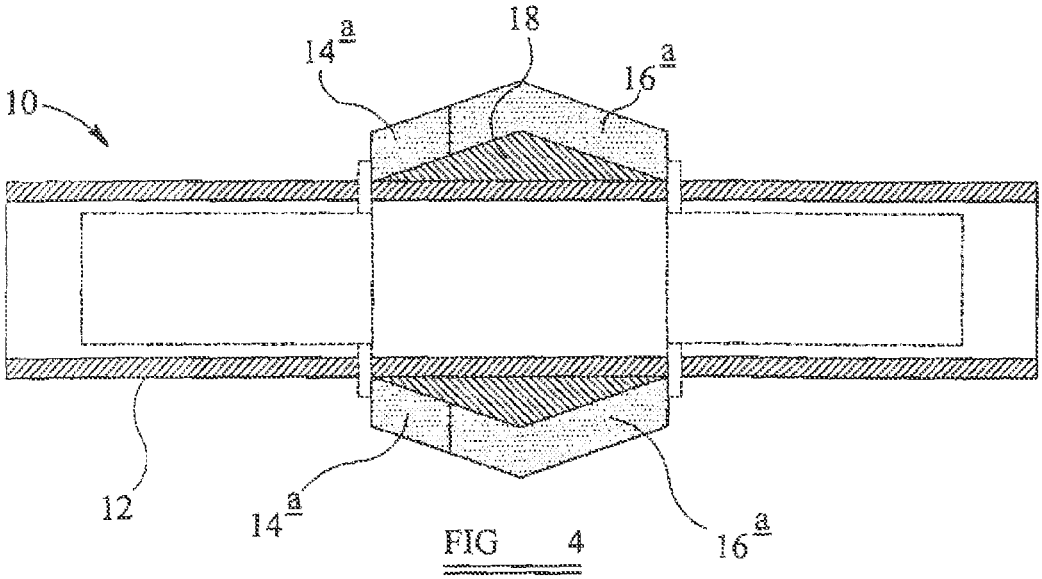

In the present embodiment, the sealing portions 14, 16 are formed, at least partially, of a swelling material adapted to swell upon contact with a suitable activator, such as water or hydrocarbons or the like. Thus, when the swelling material of the sealing portions 14, 16 is exposed to a suitable activator said sealing portions 14, 16 will radially expand, as shown in FIG. 4, which shows the seal 10 in a fully expanded configuration. Accordingly, in use, radial expansion of the downhole seal 10 may be achieved by the radial displacement of the sealing portions 14, 16 by engagement with the deflecting portion 18, in combination with swelling of the swellable material forming the sealing portions 14, 16. As such, the downhole seal 10 may advantageously be employed, for example as a packer, in environments where a large expansion ratio is required, such as in situations where the intended location of the seal can only be accessed via passageways or conduits of restricted or reduced internal dimensions and profiles.

Figure 5:
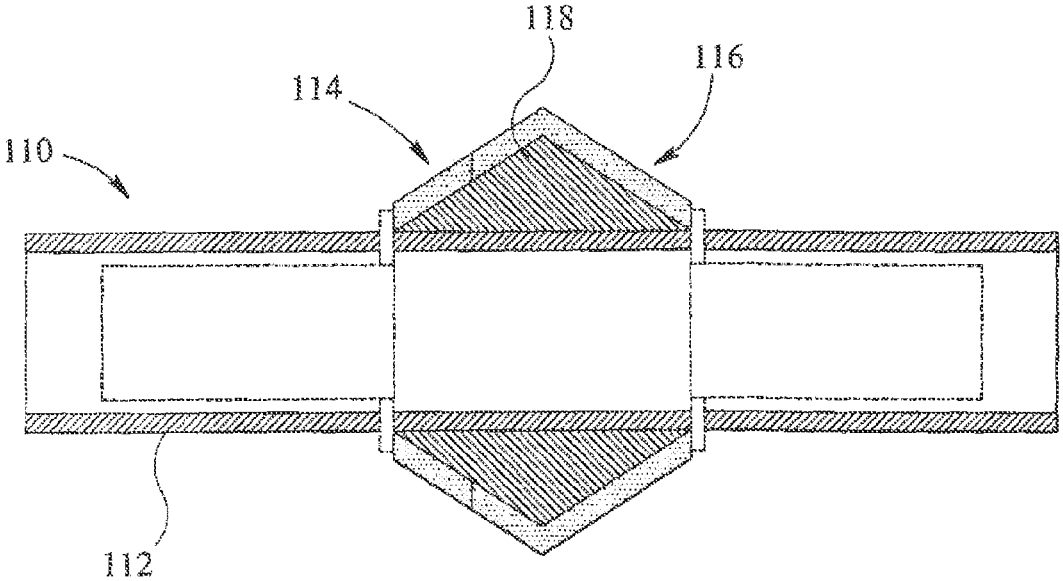
FIG. 5 is a longitudinal cross-sectional view of a downhole expandable seal in accordance with an alternative embodiment, wherein the seal is shown in an expanded configuration.

A downhole seal, generally identified by reference numeral 110, in accordance with an alternative embodiment is shown in FIG. 5. The seal 110 is similar to seal 10 first shown in FIG. 1 and as such like components share like reference numerals, incremented by 100. Thus, the seal 110 includes a tubular body 112 which supports a deflecting portion 118 and first and second sealing portions 114, 116. The operation of the downhole seal 110 is similar to that of seal 10 and as such no further explanation will be given. However, in the present embodiment the deflecting portion 118 is formed, at least partially, by a swelling material. In this respect the seal 110 is shown in FIG. 5 in a fully expanded configuration, with the sealing portions 114, 116 radially displaced and the deflecting portion 118 expanded by swelling of the swelling material.

In an alternative embodiment, which has not been illustrated, the sealing and deflecting portions may all include a swelling material.

Figure 6:
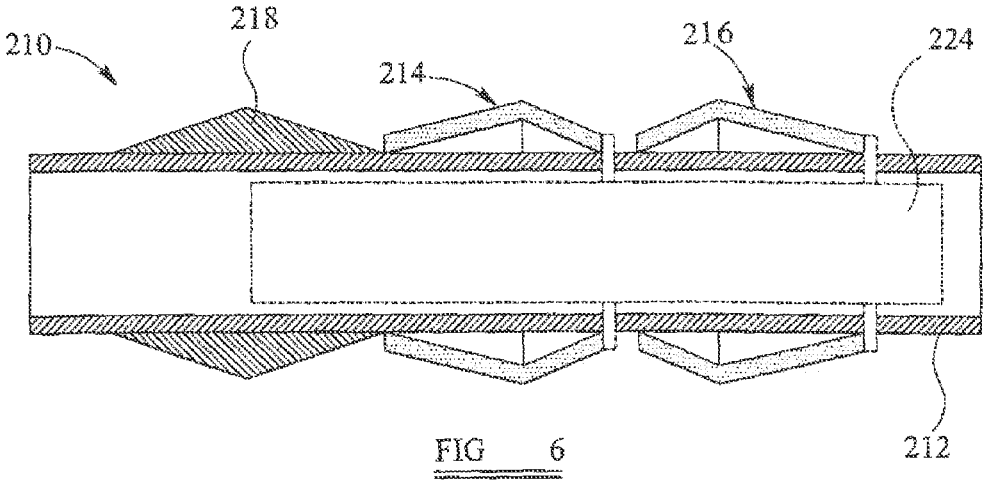
FIGS. 6 and 7 are longitudinal cross-sectional views of a downhole expandable seal in accordance with a further alternative embodiment, shown in unexpanded and partially expanded configurations.
Figure 7:
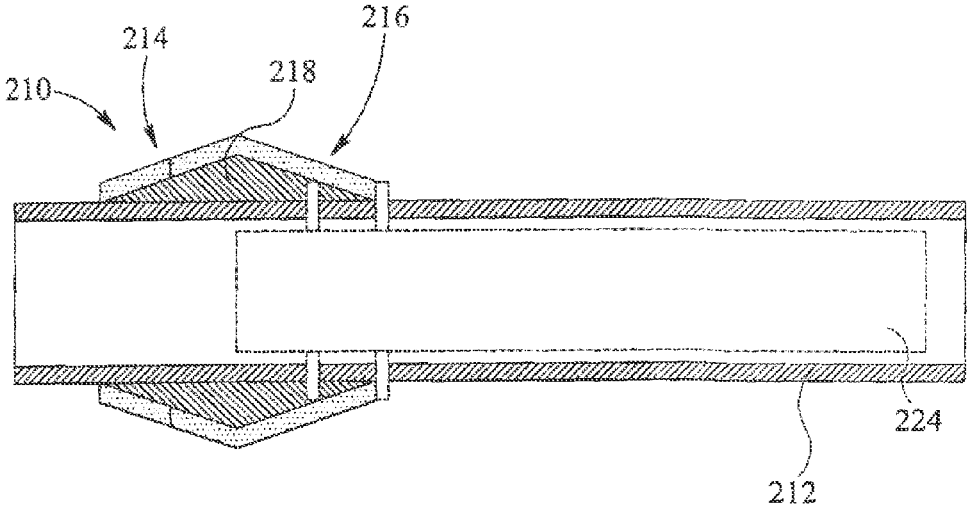

A further alternative embodiment of a downhole seal is shown in FIGS. 6 and 7. The downhole seal, generally identified by reference numeral 210, is similar to the seal 10 first shown in FIG. 1 and as such like features are identified by like reference numerals, incremented by 200.

In the present embodiment, the downhole seal 210 includes a tubular body 210 which supports a deflecting portion 218 and first and second sealing portions 214, 216. When the seal 210 is in an unexpanded configuration, as shown in FIG. 6, the first and second sealing portions 214, 216 are both located on one side of the deflecting portion 218. A piston drive assembly 224 is provided to axially translate both the sealing portions 214, 216 towards the deflecting portion 218 to effect radial displacement of each sealing portion 214, 216. The seal 210 is shown in FIG. 7 in a partially extended configuration. In this respect one or all of the sealing and deflecting portions 214, 216, 218 include a swelling material which is caused to swell upon exposure to a suitable activator to reconfigure the seal 210 into a fully expanded configuration.

Figure 8:
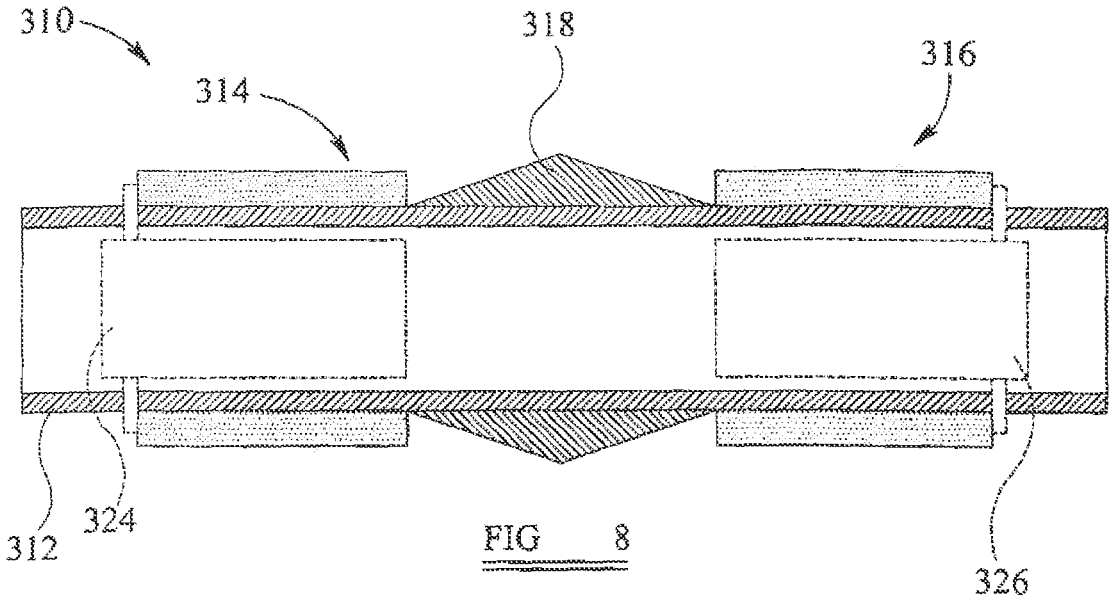
FIGS. 8 and 9 are longitudinal cross-sectional views of a downhole expandable seal in accordance with a further alternative embodiment, shown in unexpanded and partially expanded configurations.
Figure 9:
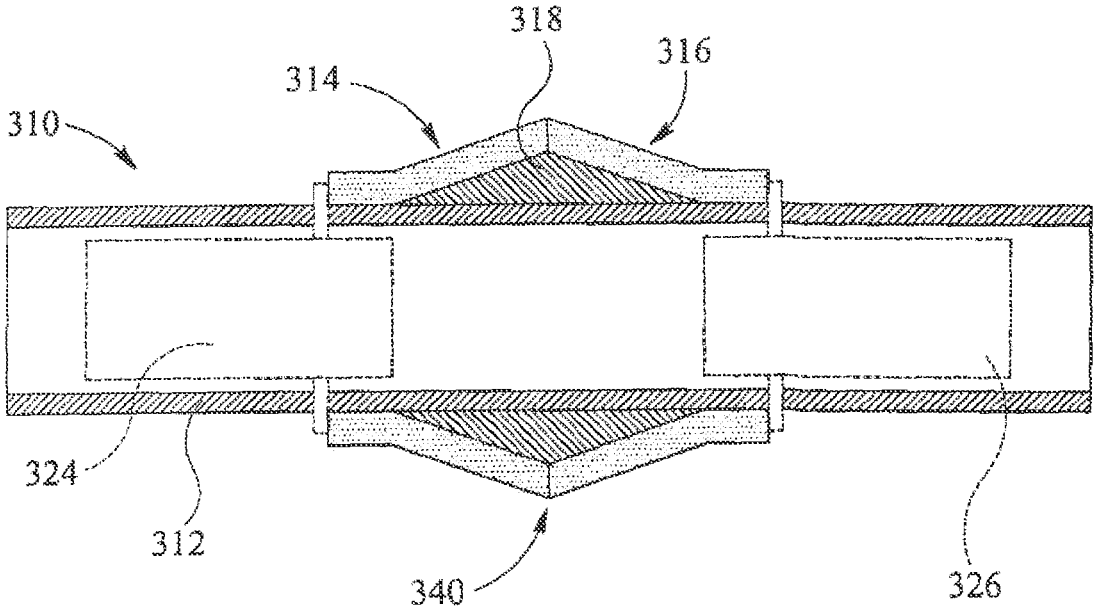

FIGS. 8 and 9 show another alternative embodiment of a downhole seal. The downhole seal, in this case generally identified by reference numeral 310, is similar to the seal 10 first shown in FIG. 1 and as such like features are identified by like reference numerals, incremented by 300.

The seal 310 includes a tubular body 312 which supports a deflecting portion 318 in the form of a double-sided cone, and first and second sealing portions 314, 316 in the form of deformable sleeves. When the seal 10 is in an unexpanded configuration, as shown in FIG. 8, the sealing portions 314, 316 are located on either side of the deflecting portion 318. In the present embodiment the sealing portions 314, 316 are caused to be translated relative to the deflecting portion 318 by drive assemblies 324, 326 and engagement with the deflecting portion 318 effects radial displacement of the sealing portions 314, 316. When the sealing portions 314, 316 are fully axially translated they are caused to abut at location 340, as shown in FIG. 9, in which the seal 310 is positioned in a partially expanded configuration. In a similar manner to the previous embodiments, one or more of the sealing and deflecting portions 314, 316, 318 include a swelling material which is caused to swell to reconfigure the seal 310 into a fully expanded configuration.

Figure 10:
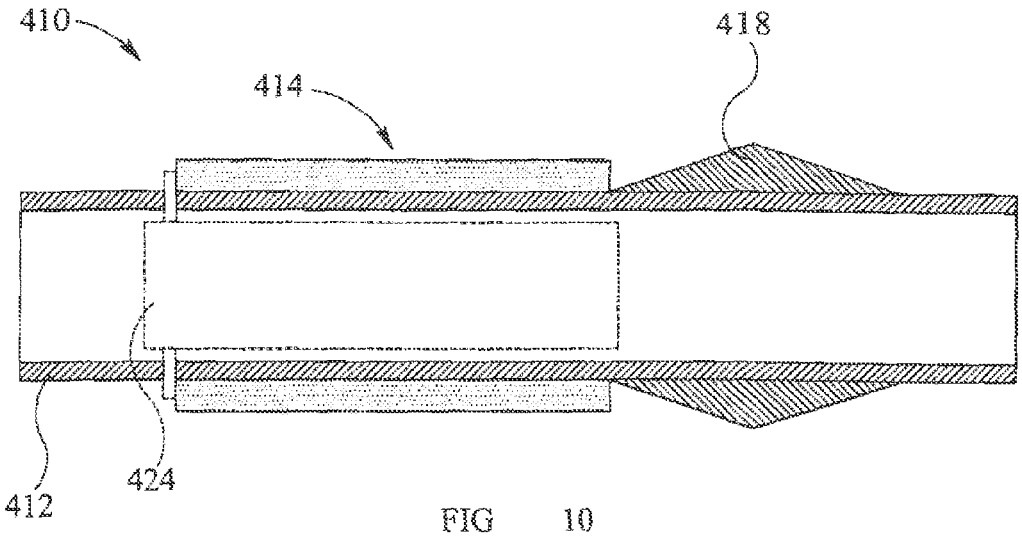
FIGS. 10 and 11 are longitudinal cross-sectional views of a downhole expandable seal in accordance with a still further alternative embodiment, shown in unexpanded and partially expanded configurations.
Figure 11:
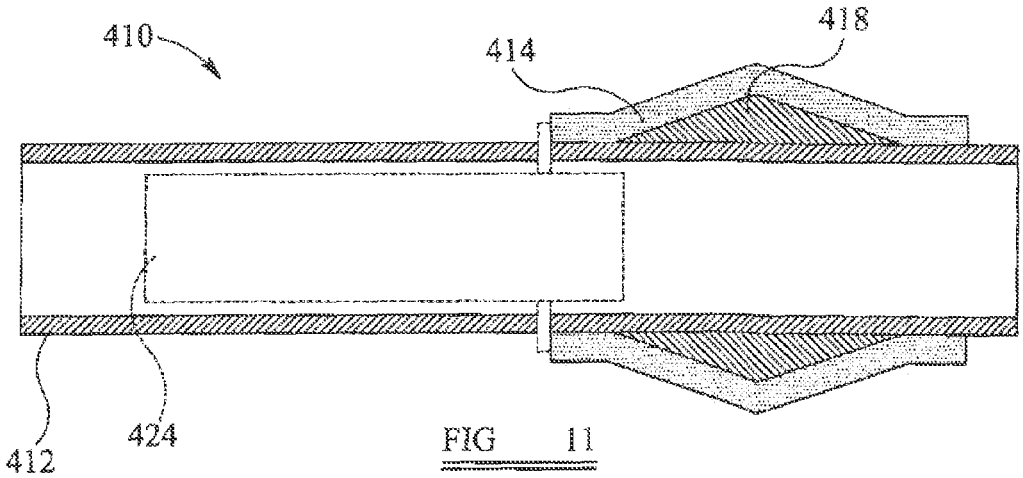

Reference is now made to FIGS. 10 and 11 in which there is shown a downhole seal, generally identified by reference numeral 410, in accordance with a further alternative embodiment. Seal 410 is similar to seal 10 first shown in FIG. 1 and as such like components share like reference numerals, incremented by 400. The seal 410 is shown in FIG. 10 in an unexpanded configuration and in FIG. 11 in a partially expanded configuration.

In this embodiment the seal 410 includes a tubular body 412 which supports a deflecting portion 418 and a single sealing portion 414 in the form of a sleeve. In use, a drive assembly 424 translates the sealing portion 414 over the deflecting portion 418 to the configuration shown in FIG. 11. One or both of the sealing portion 314 and deflecting portion 318 includes a swelling material which swells upon contact with a suitable activator to configure the seal 410 into a fully expanded configuration.

As described above, seals according embodiments described herein may be provided which are capable of achieving extremely large expansion rations, without compromising mechanical strength or sealing integrity. This is achieved by a combination of radially displacing one or more sealing portions by interacting with a deflecting member, and forming one or more components of the seal with a swelling material. Thus, a seal may be delivered through a small diameter conduit, channel, passage or the like and subsequently expanded into a significantly larger conduit, channel, passage or the like.

It should be understood that the embodiments described above are merely exemplary and that various modifications may be made thereto without departing from the scope of the invention. For example, the seals may alternatively, or additionally, be utilised as an anchor. Furthermore, any number of sealing portions may be provided, and the sealing portions may be adapted to become radially stacked to effect expansion of the seal. Each sealing portion may be provided as a unitary component, or alternatively may include a number of individual components which may or may not be coupled together. Similarly, the deflecting member may be provided as a unitary component, or alternatively may include a number of individual components which may or may not be coupled together.

Any suitable drive assembly, means or system may be utilised to axially translate the sealing portions.

Furthermore, the sealing portion or portions of the seal may be at least partially covered by a further component or material, such as a rubber sleeve or the like, such that radial displacement of the sealing portions and swelling of the swelling material will move the cover into engagement with a bore wall or the like. The cover may assist in establishing and maintaining a seal. Also, the cover may assist to protect the other components of the seal, such as the sealing and deflecting portions.

What is claimed is:

1. An expandable downhole seal comprising:

a sealing portion and a deflecting portion adapted to move axially relative to each other to effect radial deflection of the sealing portion, wherein at least one of the sealing portion and the deflecting portion comprises a swelling material, and at least one of the sealing and deflecting portions comprises a cam surface adapted to effect radial deflection of the sealing portion by overlapping of the sealing and deflecting portions in an axial direction upon relative axial movement of the sealing and deflecting portions; and a support member adapted to support the sealing portion and deflecting portion.

2. The expandable downhole seal according to claim 1, wherein the sealing portion defines a first sealing portion and the expandable downhole seal further comprises a second sealing portion, wherein relative axial movement of the first and second sealing portions and the deflecting portion effects radial deflection of at least the first sealing portion.

3. The expandable downhole seal according to claim 2, wherein the first and second sealing portions are adapted to interengage.

4. The expandable downhole seal according to claim 3, wherein the first and second sealing portions are adapted to overlap each other in an axial direction.

5. The expandable downhole seal according to claim 3, wherein the first and second sealing portions are adapted to interleave each other.

6. The expandable downhole seal according to claim 5, wherein the first and second sealing portions comprise complementary interleaving features.

7. The expandable downhole seal according to claim 2, wherein at least one of the first and second sealing portions and the deflecting portion is fixed relative to the support member, wherein movement of the remaining portions produce relative axial movement.

8. The expandable downhole seal according to claim 2, wherein the first and second sealing portions are located on axially opposed sides of the deflecting portion.

9. The expandable downhole seal according to claim 2, wherein the first and second sealing portions are located on the same axial side of the deflecting member.

10. The expandable downhole seal according to claim 2, wherein the sealing portion is adapted to directly engage an inner surface of a bore.

11. The expandable downhole seal according to claim 1, wherein the sealing portion is adapted to indirectly engage an inner surface of a bore.

12. The expandable downhole seal according to claim 1, wherein one of the sealing and deflecting portions is fixed relative to the support member and the other of the sealing and deflecting portions is axially moveable relative to the support member.

13. The expandable downhole seal according to claim 1, wherein both the sealing and deflecting portions are axially moveable relative to the support member.

14. The expandable downhole seal according to claim 1, wherein the deflecting portion comprises a cam surface adapted to radially deflect the sealing portion.

15. The expandable downhole seal according to claim 1, wherein the sealing portion comprises a unitary component.

16. The expandable downhole seal according to claim 1, wherein the sealing portion comprises a plurality of components which collectively define the sealing portion.

17. The expandable downhole seal according to claim 1, wherein the seal portion comprises a swelling material.

18. The expandable downhole seal according to claim 1, wherein the deflecting portion comprises a swelling material.

19. The expandable downhole seal according to claim 1, wherein the downhole seal is adapted to be retrievable.

20. The expandable downhole seal according to claim 19, wherein relative axial movement of the sealing and deflecting portions in a reverse direction effects radial displacement of the sealing portion in a direction to release or relax the seal, thus permitting the support member to be withdrawn or moved to an alternative location.

21. A method of establishing a seal within a wellbore, said method comprising:

providing an expandable downhole seal according to claim 1;

running said downhole seal into a well bore when in a first, unexpanded configuration;

reconfiguring the downhole seal into a second, expanded configuration by effecting relative axial movement of the sealing portion and the deflecting portion to effect radial deflection of the sealing portion; and permitting the swelling material to swell.

22. The method according to claim 21, further comprising running the downhole seal into a well bore filled with a material which does not initiate swelling of the swelling material.

23. The method according to claim 22, further comprising displacing wellbore fluid with a swelling activator once the downhole seal has reached or is approaching a desired location within the wellbore.

24. An expandable downhole seal comprising:

a sealing portion and a deflecting portion adapted to move axially relative to each other to effect radial deflection of the sealing portion, wherein at least the deflecting portion comprises a swelling material, and at least one of the sealing and deflecting portions comprises a cam surface adapted to effect radial deflection of the sealing portion by overlapping of the sealing and deflecting portions in an axial direction upon relative axial movement of the sealing and deflecting portions; and a support member adapted to support the sealing portion and deflecting portion.

25. The expandable downhole seal according to claim 24, wherein the sealing and deflecting portions are adapted to interengage upon relative axial movement thereof, wherein said interengagement effects radial deflection of the sealing portion.

26. The expandable downhole seal according to claim 25, wherein interengagement of the sealing and deflecting portions is achieved by overlapping of said portions in an axial direction.

* * * * *